United States Patent [19]

Briaire

[11] 3,981,129

[45] Sept. 21, 1976

[54] METHOD AND DEVICE FOR THE FELTING OF SLIVER AND SUCHLIKE INTO FELTED YARNS

[75] Inventor: Henricus Cornelis Johannes Briaire, Nootdorp, Netherlands

[73] Assignee: IWS Nominee Company Limited, Ilkley, England

[22] Filed: May 2, 1975

[21] Appl. No.: 573,826

[30] Foreign Application Priority Data

May 16, 1974 Netherlands ..... 7406622

[52] U.S. Cl. ..... 57/35; 28/5; 28/72.3; 57/156; 68/DIG. 1; 226/113; 226/190

[51] Int. Cl.[2] ..... D04H 17/00

[58] Field of Search ..... 57/156, 34 R, 1 R, 35; 28/5, 72.3; 68/DIG. 1; 226/113, 190

[56] References Cited

UNITED STATES PATENTS

| | | | |
|---|---|---|---|
| 120,617 | 11/1871 | Bishop | 28/5 |
| 227,331 | 5/1880 | Waring | 28/5 |
| 227,332 | 5/1880 | Waring | 28/72.3 X |
| 1,738,494 | 12/1929 | Genest | 28/72.3 X |
| 2,251,931 | 8/1941 | Gundelfinger | 68/DIG. 1 |

*Primary Examiner*—Donald E. Watkins
*Assistant Examiner*—Charles Gorenstein
*Attorney, Agent, or Firm*—Harold L. Stowell

[57] ABSTRACT

Apparatus and method of making felt or felted yarns includes passing a wet wool-containing sliver or yarn through a flexible hollow tube while flexing the tube preferably in a traveling wave motion.

7 Claims, 2 Drawing Figures

METHOD AND DEVICE FOR THE FELTING OF SLIVER AND SUCHLIKE INTO FELTED YARNS

Figure 1:
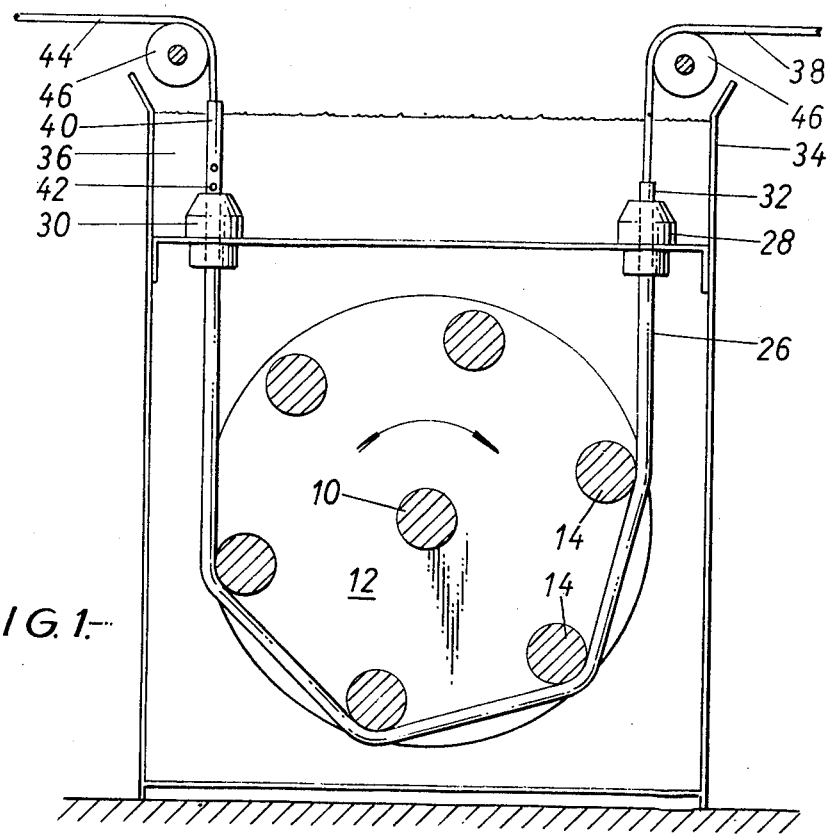

This invention relates to a method and apparatus for the production of felted or felt yarns.

Dutch patent application No. 74/03653 describes the felting of slivers by means of horizontally moving rollers. Thus, the sliver is fed through two rollers (vertically mounted), while the top and the bottom rollers are moved in axial direction relatively to each other. In order to achieve a sufficiently high production rate at the required degree of felting, 30 to 50 pairs of rollers have to be used, each with their own rotation and oscillation mechanism. Consequently the machine will be large and expensive.

This invention seeks to provide a relatively simple and inexpensive method for the felting of sliver and yarns made out of wool.

According to the present invention there is provided a method of making a felt yarn which comprises passing a wool-containing yarn or sliver in the presence of water through a guide tube, and flexing the guide tube.

The invention also provides an apparatus for making felt yarns which comprises one or more members adapted for rotation about an axis and a flexible guide tube defining a path for the yarn whereby the locus of the rotation of the members about the axis intersects the path.

The flexing or oscillation used in the method of the invention is principally transverse to the direction of motion of the yarn. A preferred form of the apparatus of the invention produces the requisite flexing of the guide tube in a manner analogous to the operation of a peristaltic pump.

The invention is equally applicable to unspun sliver, when a felt yarn (i.e. a yarn held together and deriving its strength entirely from random inter-fibre entanglement) is produced; or to an already spun yarn, when a felted yarn is produced in which the fibres are consolidated and which will resist untangling.

When feeding an untwisted sliver to the apparatus of the invention it is often beneficial to strengthen the yarn by imparting false twist to it. See for example a similar principle in our U.K. application number 58551/73.

The method of the invention, using an oscillating guide tube a few decimeters long, can produce felted yarns with an acceptable degree of felting at a production rate which is comparable with that of conventional spinning processes.

The internal cross-section of the guide tubes should be between 5 and 60 $mm^2$/ktex; a lower diameter may result in too slow a felting procedure and/or in too low a degree of felting, while the transport of the yarn through the tubes will be difficult. A larger diameter may result in a yarn which is too flat for most applications.

If the oscillating motion is that of a transverse wave then the sliver or yarn undergo forces which result in the transportation of the wool through the tube. Thus if there is no tension on the wool at either end of the tube, a direct relationship between the rate of transport and the frequency of the wave can be observed. This makes it possible to transport the wool without tension through the guide tubes, which is favourable to the felting process.

At its simplest, the apparatus of the invention could consist of a straight tube which is brought into a reciprocating motion through a crank, cam or similar mechanism. The inner section of the tube is preferentially circular, as other shapes might lead to an undesired shape of the yarn.

The felting process is accelerated markedly by the use of a flexible tube which is linked at only one or a few places to the apparatus. As the recovery rate of the flexible tube is relatively low, a wave motion results, which appears to have a favourable effect on the felting process.

A tube of elastic material, such as rubber, or a helical spring with a small pitch could be used for this purpose. In this way a stationary wave motion will be generated. by a proper setting of the device which creates the motion, a travelling wave can be generated. In that case, besides the felting action, a transporting action is also obtained.

This latter property makes it possible to feed the yarn through the system without tension, so that the required degree of felting is achieved in a shorter period of time.

As the invention utilises the unique properties of keratinous fibres, and especially wool, it is preferred that the proportion of such fibres be as high as possible to produce the best results. However, blends of wool with other fibres may be employed provided that the proportion of wool is not too low.

The method and apparatus of the invention work best on higher count yarns and are particularly advantageous when used to treat or make yarns intended for use in carpets.

Currently-used spun yarns intended for use in cut pile carpets are often subjected to a felting treatment before being made up into the carpet. This is usually done as a batch process by agitating hanks of the yarn in the presence of a felting solution (e.g. acid or alkaline aqueous solution, containing detergent). Yarns not so-treated often separate in wear and give the carpet a "matted" appearance as the fibres become entangled with those from adjacent yarns. The present invention provides a much more economical continuous method of felting spun yarns and, further, offers the option of cutting out the spinning stage altogether and producing a felt yarn directly from unspun sliver.

Yarns of the invention produced from sliver are compact and hard wearing. Even after a great deal of wear in a cut-pile carpet they do not lose their identity as separate yarns. Further, because of the fibre configuration in these yarns, the observed intensity of colouration is enhanced compared to conventional yarns for the same dyeing conditions. This is particularly noticeable at the yarn ends which of course is especially important in cut-pile carpets.

For example, a test piece of carpet was made up in two halves: the first from standard spun carpet yarn of 2,700 tex, and the second from 2,700 tex felt yarns produced from sliver by the method of the invention. The density was 20,000 tufts/$m^2$. After a wear trial equivalent to approximately 10,000 walkings-on, the standard yarns had lost their identity and that half of the carpet had a matted appearance. The half with the felt yarns still retained its original "as-new" appearance. Further, the felt yarn half appeared to be brighter in colour.

Owing to frictional properties of the guide tube in the apparatus of the invention, greater yields (in metres/- min) can be obtained with higher count yarns. Speeds of up to 20 meters/min can be obtained, although for general purposes speeds of 8 to 12 meters/min are preferred.

Figure 2:
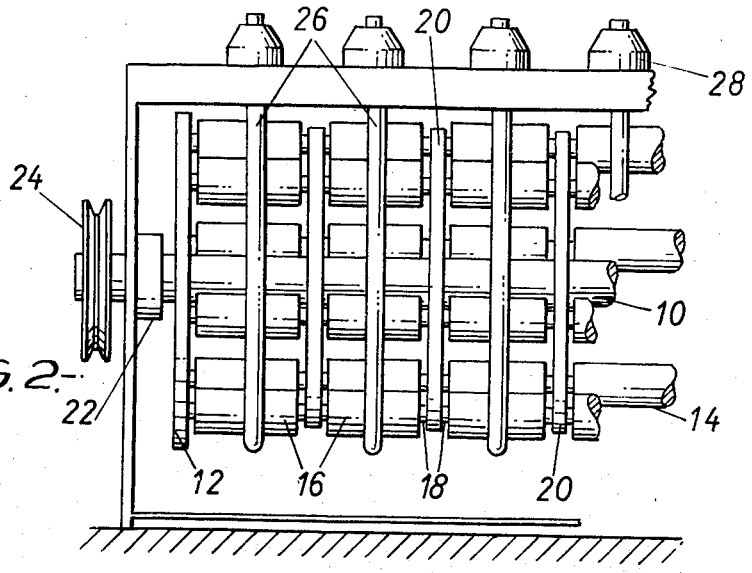

The invention will be described further, by way of example, with reference to the accompanying drawings in which:

FIG. 1 is a diagrammatic side view of an apparatus constructed according to the invention; and FIG. 2 is a front view of the apparatus of FIG. 1.

Referring to the drawings, a shaft 10 carries a pair of end-plates 12 attached to which are six equally spaced rotor members 14. The rotor members 14 comprise rollers 16 of smooth plastics material mounted on axles 18 carried between the end plates 12 and a number of supporting discs 20. The shaft 10 is mounted on bearings 22 carried in the frame of the apparatus and is rotated by means of a belt drive to a pulley 24.

Flexible guide tubes 26 made from silicone rubber are fixed in bosses 28,30 in the top of the apparatus. The tension of the guide tubes 26 is such that during rotation of the shaft/rotor member assembly contact is maintained between the tube 26 and the rollers 16, but flattening of the tube does not take place. The inlet bosses 28 each carry a short metal tube 32 which projects into a header tank 34 (omitted from FIG. 2 for clarity) filled with felting solution 36. Ingoing sliver 38 is wetted by this solution 36 and carries a portion of it through the guide tubes 26. The exit bosses 30 each have a longer guide tube 40 projecting above the liquid surface. Holes 42 in the tube 40 allow the bulk of the solution carried through the guide tubes 26 to return to the tank 34 without interfering with the egress of felted yarn 44. Supporting rollers 46 are provided to steady both the ingoing sliver 38 and the resultant felt yarn 44.

As can be seen from FIG. 1, the gude tubes 26 bend where the rollers 16 are and are straight in between. Thus when the shaft is driven, the bends in the tubes 26 move with the rollers 16 and the parts of the tubes between the rollers show an amplitude toward the central shaft 10. The result appears as a travelling transverse wave motion of the guide tubes 26. The sliver 38 is felted by this wave motion to a felt yarn 44 which is led off for storage and/or further use.

Despite the fact that the rollers 16 are free to rotate about their axes 18, it has been found that at operating speeds a great deal if slippage takes place between the rollers 16 and the tubes 26. It is therefore beneficial to provide lubrication. Water or excess felting solution accomplishes this lubrication and greatly reduces wear on the tubes 26.

The sliver may be transported through the tube by the waving action itself and no separate force is required. The rate with which the sliver moves increases with speed of the rollers 16. Typical shaft speeds lie in the range 400 –1500 rpm with speeds of about 9 –1200 rpm given good results.

The degree of felting is usualy sufficient for the normal areas of application for wool yarns. If, however, a higher degree of felting is required, for instance when the sliver only partly consists of wool, the yarn can be immediately fed into a second tube for a second felting cycle. Alternatively longer tubes can be employed which could be wound twice the rotor.

In order to protect the tubes and to prolong the time they can be used, a belt can be placed between the rollers and the tube. This belt is fixed to the frame of the machine and consists of a material which is flexible but cannot be stretched such as reinforced rubber.

As the movement of the end of the tubes may be large, which could damage and eventually damage the tubes, a fubber of elastic material may be mounted to the frame to restrain the oscillating movement of the tube near the bosses 30. The buffer could for instance be made form foamrubber. Other ways of reducing this oscillation, include providing the bosses 30 with a flexible donwardly tapering connection to the tubes 26; or increasing the distance of the bosses 30 from the rotor assembly.

Apart from slivers, folded wool yarns can also be felted by the method described.

The following are examples of yarns produced according to the invention:

EXAMPLE I

A sliver (2700 tex) consisting of 100% wool with a moisture content of 200% was felted according to the method described above. The rotor of the machine had a diameter of 175 mm and the internal diameter of the tubes was 6 mm and the external diameter 9 mm, while the machine rotated at 1200 r.p.m. The yarn which was produced at 7 meter/min. appeared to have a tear strength of 9200 gf.

EXAMPLE II

With the exception of the mouthpiece which had an internal diameter of 2m a 100% wool sliver (500 tex) was felted under the conditions as described in Example I, to give a felted yarn with a tear strength of 1850 gf.

EXAMPLE III

A felted yarn with a tear strength of 12900 gf. was produced from a sliver (2700 tex) which consisted of 55% wool and 45% polyester. The conditions were identical to the ones employed in Example II.

The yarns or slivers may be fed into the apparatus of the invention either in the direction of, or counter to, the rotation of the members although the former is preferred. The felt or felted yarn may be drawn out of the apparatus by, for example, rollers.

What is claimed is:

1. A method of felting wool-containing fibres consisting essentially of the steps of a. providing a flexible guide tube;

b. passing wet wool-containing fibres through said guide tube; and c. simultaneously with step (b), flexing said guide tube.

2. A method as claimed in claim 1 wherein the flexing step of the guide tube imparts a wave motion thereto.

3. A method according to claim 2, wherein the imparted wave motion is that of a travelling wave.

4. A method according to claim 1, for producing a felt yarn from fibers wherein false-twist is imparted to the fibers before they are passed into the guide tube whereby to promote entanglement of the fibres.

5. Apparatus for felting wool-containing fibres comprising a flexible guide tube, means for passing a wet wool-containing fibre through said flexible guide tube, and means for flexing said guide tube during the passage of the wet wool containing fibres therethrough.

6. An apparatus as claimed in claim 5 wherein the guide tube is made from silicone rubber.

7. An apparatus as claimed in claim 5 wherein the means for flexing said tube comprise rollers mounted on a disc rotable about its centre and the tube is stretched over the rollers.

* * * * *